US007494191B1

(12) United States Patent
Crites

(10) Patent No.: US 7,494,191 B1
(45) Date of Patent: Feb. 24, 2009

(54) MANHOLE RING SAW CUTTING DEVICE

(76) Inventor: Michael Crites, 556 Honeysuckle Bend, Lima, OH (US) 45807

( * ) Notice: Subject to any disclaimer, the term of this patent is extended or adjusted under 35 U.S.C. 154(b) by 20 days.

(21) Appl. No.: 11/818,148

(22) Filed: Jun. 14, 2007

(51) Int. Cl.
*E21C 25/00* (2006.01)

(52) U.S. Cl. ..... 299/41.1; 30/105; 125/13.03

(58) Field of Classification Search ..... 299/41.1, 299/39.3, 39.1, 39.5, 39.6; 125/13.01, 14, 125/13.03; 30/103, 105
See application file for complete search history.

(56) References Cited

U.S. PATENT DOCUMENTS 4,924,951 A 5/1990 Paulson
5,934,820 A 8/1999 Hinkle
6,131,557 A * 10/2000 Watson ..... 125/13.01
6,161,985 A 12/2000 Hinkle et al.
6,536,987 B2 3/2003 Chang
6,709,064 B2 3/2004 Nettek

OTHER PUBLICATIONS

Exhibit A Whirly Gig Company printout, undated.

* cited by examiner

*Primary Examiner*—Sunil Singh
(74) *Attorney, Agent, or Firm*—Harpman & Harpman

(57) ABSTRACT

A ring saw device used in the installation of manholes to afford proper installation height and angular inclination compliant to street surface. The ring saw cutting device has a support ring base that acts as an elevated and inclination guide with a dual axis cutting assembly rotatably disposed therewithin.

5 Claims, 6 Drawing Sheets

MANHOLE RING SAW CUTTING DEVICE

BACKGROUND OF THE INVENTION

1. Technical Field

This device relates to specialized power equipment for the removal and replacement of manhole assemblies. Such equipment has been developed that simplify the removal and installation of sanitary manhole configurations including chimney reconstruction in accordance with the compliance of state and local specifications.

2. Description of Prior Art

Prior art devices of this type have been directed towards initially hand held cutters used to cut the chimney liner used to adjustably position the manhole casing on the support cone. A variety of bracket assemblies have been developed to support and guide cutting elements within the manhole. Other support mounted manhole cutting devices can be seen in combination with removal and preparation tools in U.S. Pat. Nos. 4,924,951, 6,539,987, and 6,709,064.

In U.S. Pat. No. 4,924,951 a manhole cutter is disclosed that is inserted into an existing manhole to a depth sufficient to engage and remove the manhole by clamping thereto and cutting from the inside surface.

U.S. Pat. No. 6,539,987 is a quick manhole construction method wherein a cutting unit is lowered into the manhole engaging the inside surface cuts with the removal of the manhole casing.

U.S. Pat. No. 6,709,064 claims a method and device for detaching or cutting out an embedded manhole frame having a cutter attached to the manhole performing eccentric circumferential runs along the inside thereof for removal.

An example of a commercially available device that is known which is directed towards the cutting of the plastic forms used to extend the mounting surface from the manhole "cone" and are left in place after cutting. The device is manufactured by the Whirly Gig Company shown in an informational print-out exhibit A in which a router type tool is mounted on an arm that extends from a central support shaft held by a pair of cross brackets extending outwardly over the manhole to support same.

SUMMARY OF THE INVENTION

A cutting tool to facilitate the installation of a manhole requiring the cutting of a mounting support chimney to its proper elevation and matching angular inclination to the installation street surface and a two axis planar orientation. The tool provides for both trans-dimensional and annular movement of a cutting saw positioned within by a rotatable frame and movable carriage thereon. The cutting saw is secured within the movable carriage for elevational adjustment and trans-annular movement thereabout.

DETAILED DESCRIPTION OF THE INVENTION

Figure 1:
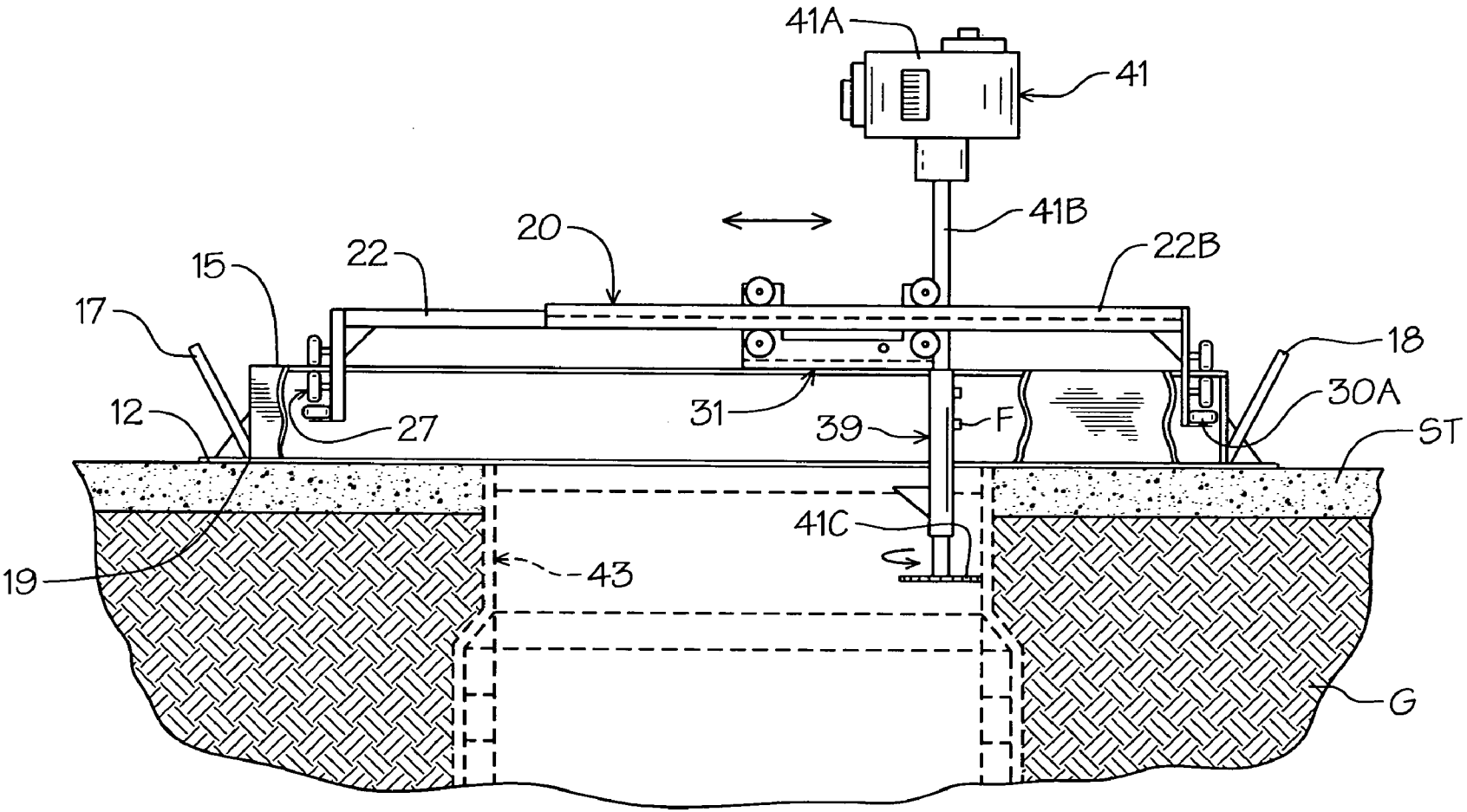
FIG. 1 is a side elevational view with portions broken away of the ring saw cutting device of the invention.
Figure 2:
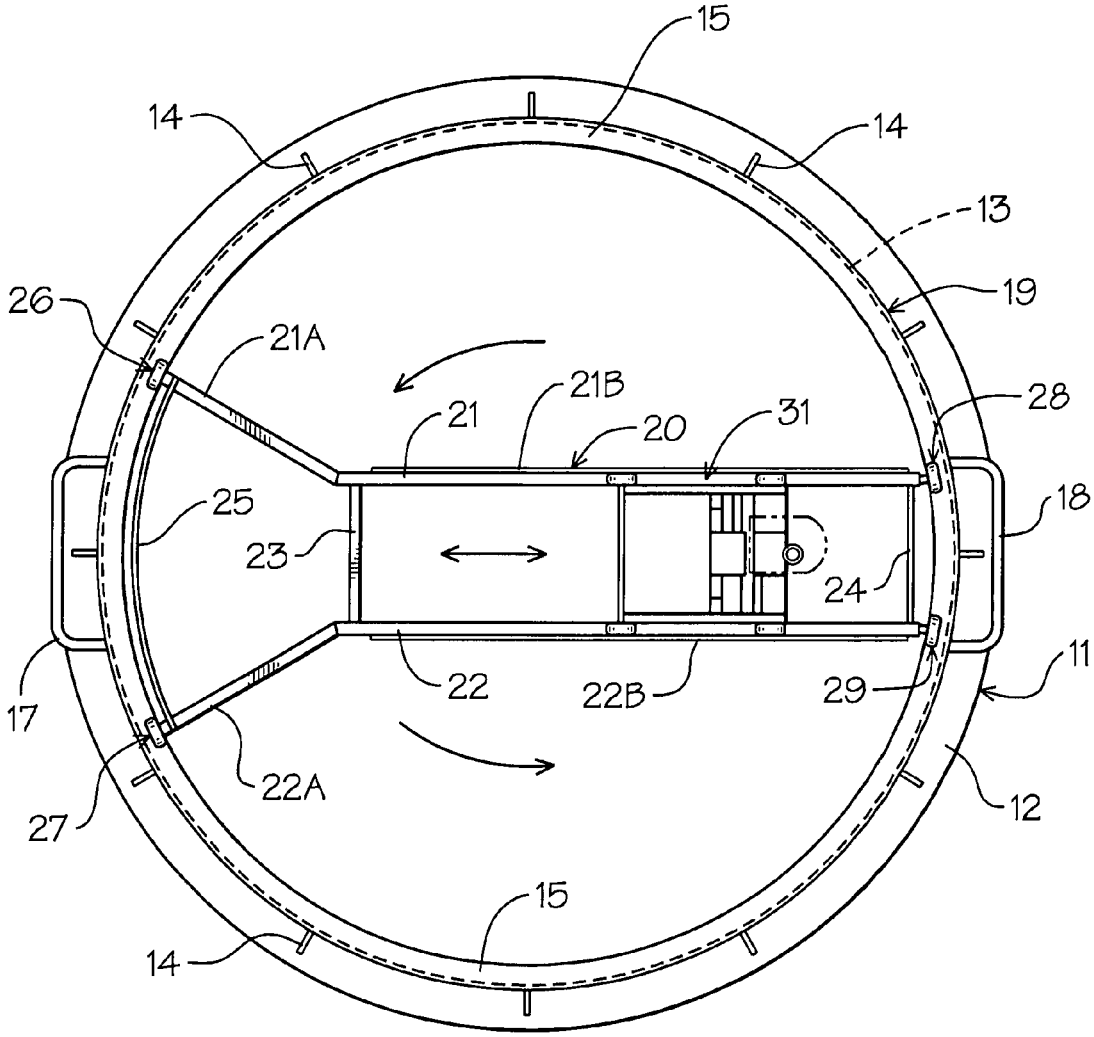
FIG. 2 is a partial top plan view with portions broken away for clarity.

Referring to FIGS. 1 and 2 of the drawings, a manhole ring saw 10 of the invention can be seen having an annular support and stabilizing base 11 having a ground engagement flange 12 extending therefrom and an upstanding contoured sidewall 13. A plurality of reinforcing gussets 14 extend between the sidewall 13 and flange 12 radially in spaced annular relation to one another. A guide engagement lip 15 extends inwardly at right angles from an upper edge surface 16 of the sidewall 13, best seen in FIG. 1 of the drawings. A pair of mobility handles 17 and 18 extend from the stabilization base 11 at the juncture 19 of the sidewall and flange 13 and 12 respectively in oppositely disposed relation to one another.

A guide frame bridge 20 is rotatably positioned on the base 11 having a pair of spaced parallel frame elements 21 and 22 with angular offset planar support extensions 21 Å and 22A extending therefrom. A pair of tubular interconnection braces 23 and 24 extend and are secured between the end frame elements 21 and 22 defining a rectangular carriage support area therewithin.

Figure 3:
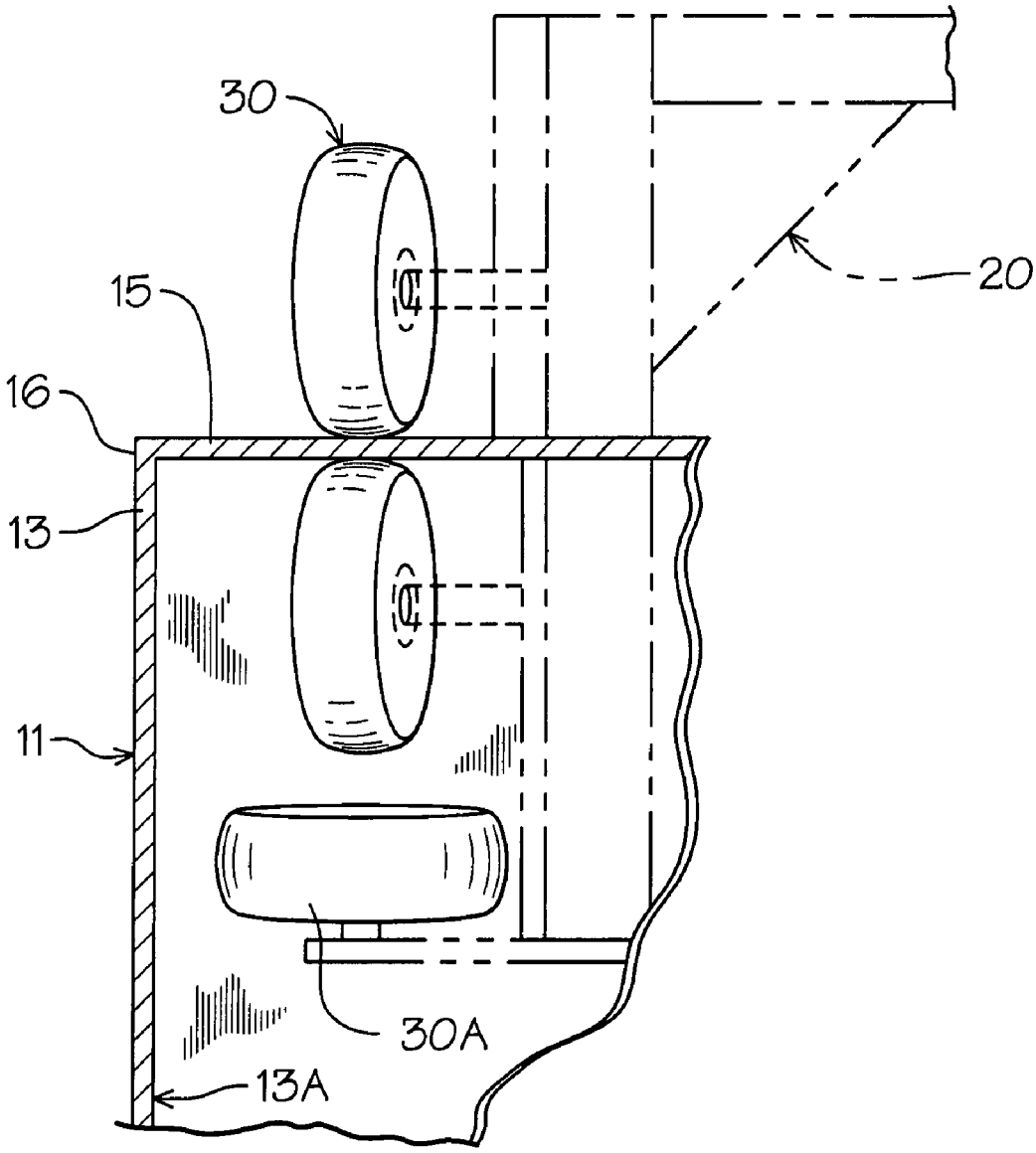
FIG. 3 is a partial side sectional view of the wheeled mounting assemblies for the rotatable frame of the device.

An arcuate end brace element 25 extends from the free ends of the frame extensions 21A and 22A, each with guide wheel assemblies 26 and 27 mounted angularly thereon, as best seen in FIGS. 1 and 3 of the drawings.

A secondary pair of guide wheel assemblies 28 and 29 extend from the frame elements 21 and 22 oppositely disposed free ends thereof. Both the guide wheel assembly pairs 26-29 each have vertically aligned opposing wheel sets 30 engageable on oppositely disposed upper and lower surfaces of the engagement lip 15 as hereinbefore described.

A single horizontally disposed wheel 30A is engageable on the inner surface 13A of the hereinbefore described base sidewall 13 in the respective wheel assemblies. It will be evident from the above description that the guide track bridge frame 20 can therefore be freely rotated 360 degrees on the base 11 with a rotational stop S extending from the interconnecting brace 24.

The frame elements 21 and 22 additionally have upstanding flanges 21B and 22B secured respectively along their outer side surfaces defining parallel carriage guide tracks.

Figure 5:
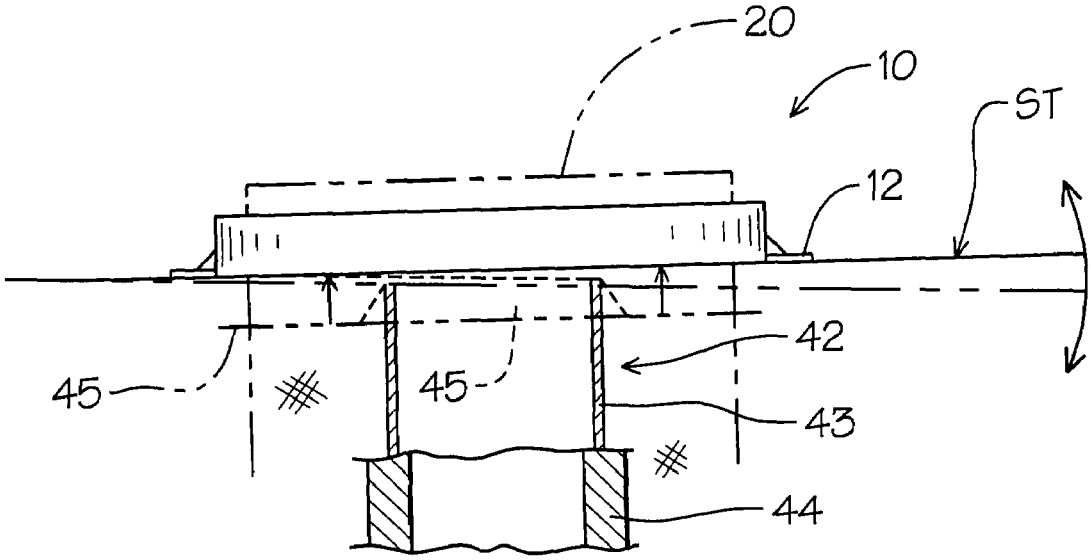
FIG. 5 is a side elevational graphic view illustrating the angular orientation of the ring saw cutting device to the manhole in use venue environment.
Figure 6:
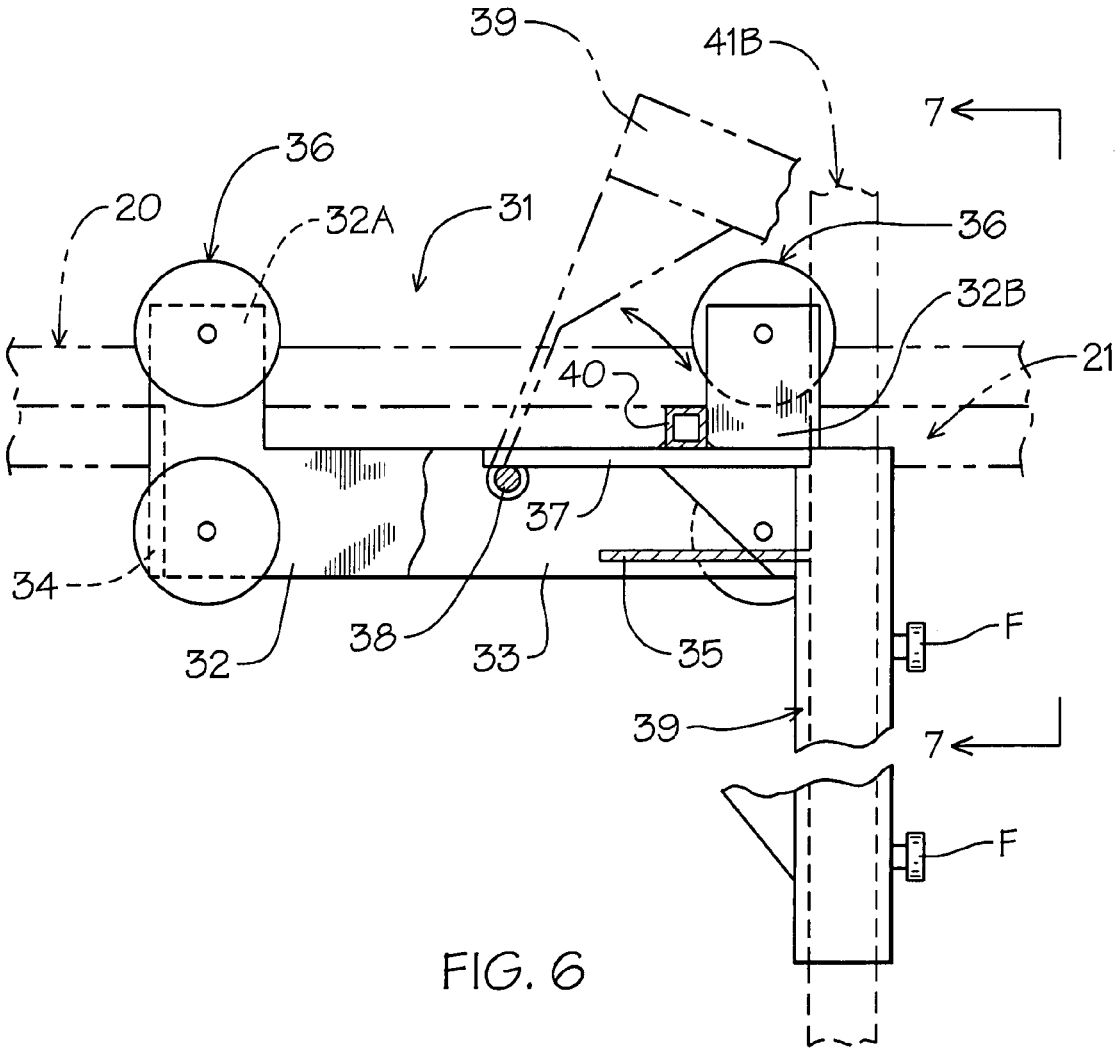
FIG. 6 is an enlarged side elevational view of the saw mounting carriage.
Figure 7:
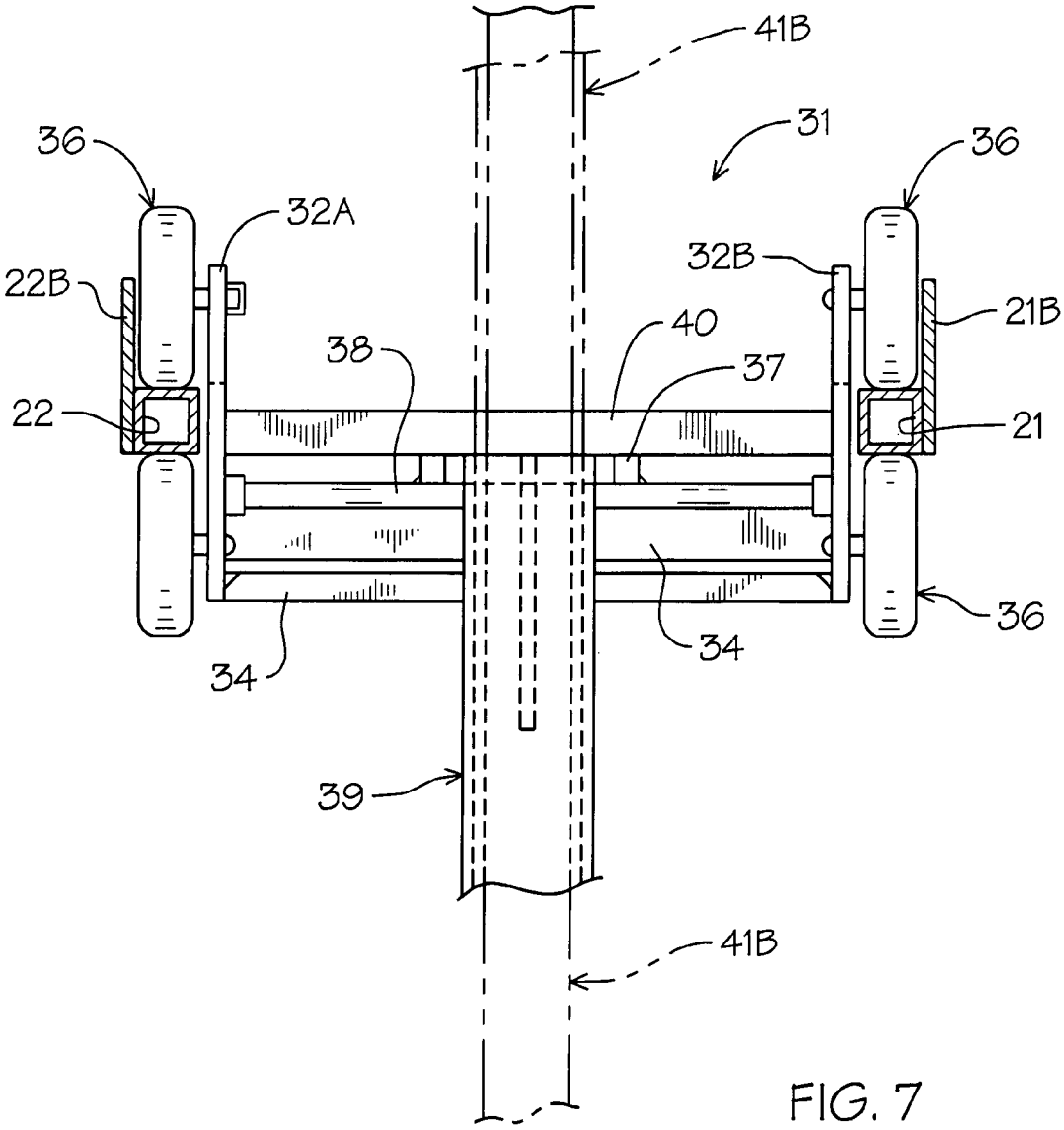
FIG. 7 is a side elevational view on lines 7-7 of FIG. 5.

Referring now to FIGS. 6 and 7 of the drawings, a saw transport carriage 31 can be seen having parallel sidewalls 32 and 33 interconnected by end plates 34 and 35. Multiple dual wheel assemblies 36 extend from the respective upstanding sidewall extensions 32A and 33A and are engaged on and under the respective guide bars 21 and 22 to as to provide for a secure movable positioning thereon. A saw mounting assembly is pivotally positioned within the transport carriage 31 having an arm plate 37 mounted to a pivot pin 38 extending between the respective sidewalls 32 and 33. The arm plate 37 is notched at its free end in which is mounted a tubular saw receiving fitting 39. A limit stop bar 40 extends across and is secured to the arm plate 37 extending transversely beyond the respective sidewalls 32 and 33 for selective engagement therewith when in use oriented position as shown in FIGS. 1 and 5 of the drawings.

A portable power saw 41 having an engine 41A from which extends an enclosed drive shaft assembly 41B and a circular saw blade 41C on its free rotatable end can be adjustably positioned for height through the tubular saw receiving fitting 39 by use of fixation fasteners F as will be well understood by those skilled in the art.

Figure 4:
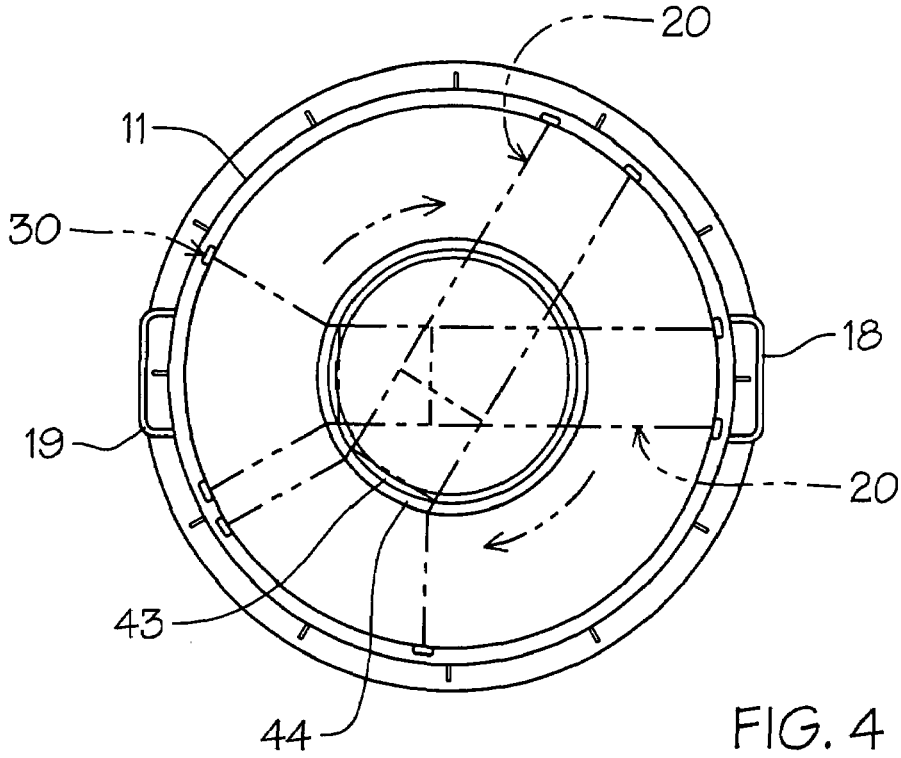
FIG. 4 is a top plan graphic representation illustrating the orientation of the ring saw cutting device to the manhole and work engagement product.

In use, as seen in FIG. 1 and graphically in FIG. 4 of the drawings, the stabilizer base 11 of the invention is centered over a manhole 42 during reconstruction in which a chimney extension 43 has been positioned on an exposed manhole cone 44 as is well known and understood within the art. It is critically important to have the chimney extension 43 at the right elevation and angular inclination to match the street surface for proper installation of a manhole frame not shown, as will be understood by those skilled in the art.

The saw mounting assembly 36 is pivotally deployed as herein before described in a vertical orientation against the stop bar 40 and the transport carriage 31 is adjustably positioned longitudinally in the guide frame track bridge 20 positioning the saw blade 41C to cut through the exposed chimney 43 which is typically made of synthetic resin material as is shown in this application illustration. The guide frame bridge 20 is then rotated within the base 11 as illustrated graphically in FIG. 2 of the drawings with the saw blade 41C of the saw 41 once activated cutting an annular path through the chimney extension 43. As noted, the base 11 imparts the corresponding street surface angular inclination at ST from horizontal illustrated by line HL of the manhole cone 44 and therefore the extending chimney 43 is appropriately cut. It is this ability to precisely cut the chimney 43 to match the street inclination in multiple planar axis that is achieved by the manhole ring saw 10 of the invention when used properly. This allows for correct placement of the manhole frame 45, shown in broken lines in FIG. 4 of the drawings, in accordance with user specification required by state and local entities which provide for specific tolerances in the positioning and mounting of the finished manhole during reconstruction or installation.

It will thus be seen that a new and novel ring saw manhole cutting device has been illustrated and described and it will be app rent to those skilled in the art that various changes and modifications may be made thereto without departing from the spirit of the invention.

Therefore I claim:

1. A ring saw cutting device for manholes comprises,
an annular ground engagement support frame,
a guide frame bridge rotatably positioned across said support frame,
a movable transport carriage within said guide frame,
a saw mount assembly pivotally secured to said transport carriage movable from a first non-engagement position to a second material engagement position,
a saw adjustably positioned within said saw mount assembly, guide frame wheel assemblies engageable on said support frame,
transport carriage wheel assemblies engageable on a portion of said guide frame.

2. The ring saw cutting device set forth in claim 1 wherein said guide frame bridge comprises,
transport carriage support tracks and angular diverging support extensions extending from one end thereof.

3. The ring saw cutting device set forth in claim 2 wherein said guide frame diverging support extensions have an arcuate end frame member therebetween.

4. The ring sow cutting device set forth in claim 1 wherein said guide frame wheel assemblies each comprises, vertical aligned opposing wheel set and a horizontally disposed wheel engageable on said around engagement support frame.

5. The ring saw cutting device set forth in claim 4 wherein said guide frame,
vertical aligned opposing wheel set is engageable on oppositely disposed upper and lower surfaces of said around engagement support frame and said horizontally disposed wheel adjacent thereto engageable on an inner vertically aligned surface of said ground engagement support frame thereto.

* * * * *